US005520436A

United States Patent [19]

Rader et al.

[11] Patent Number: 5,520,436

[45] Date of Patent: May 28, 1996

[54] SEATING UNIT WITH DISLOCATABLE DRAWER

[75] Inventors: Thomas J. Rader, McMinnville; J. Steven Helton, Morrison, both of Tenn.

[73] Assignee: Helton, Inc., Morrison, Tenn.

[21] Appl. No.: 361,092

[22] Filed: Dec. 21, 1994

[51] Int. Cl.[6] ..... A47C 7/62

[52] U.S. Cl. ..... 297/188.11; 5/58; 5/308; 312/330.1; 312/235.2; 312/237; 312/332; 312/334.23; 312/349

[58] Field of Search ..... 297/188.11; 5/58, 5/308; 312/235.2, 237, 330.1, 332, 334.23, 349

[56] References Cited

U.S. PATENT DOCUMENTS

| | | | |
|---|---|---|---|
| 967,452 | 8/1910 | Silverman | 297/188.11 |
| 1,177,390 | 3/1916 | Daniel | 5/308 |
| 1,250,946 | 12/1917 | Belden | 5/308 |
| 1,289,897 | 12/1918 | Phillips | 5/308 |
| 1,423,804 | 7/1922 | Kontorowitz | 5/308 |
| 1,928,405 | 9/1933 | Zuelke | 5/58 X |
| 2,174,582 | 10/1939 | Hudon | 5/308 |
| 2,588,071 | 3/1952 | Arton | 5/58 X |
| 2,671,228 | 3/1950 | De Maria . | |
| 2,677,833 | 5/1954 | Kroll | 5/308 |
| 2,880,426 | 4/1959 | Goldstein | 5/58 X |
| 3,312,516 | 4/1967 | Krahn . | |
| 3,462,208 | 8/1969 | Black et al. | 312/330.1 X |
| 3,610,720 | 10/1971 | Hosmer . | |
| 3,737,498 | 6/1973 | Jackson . | |
| 3,745,596 | 7/1973 | Copeland | 5/308 |
| 3,928,523 | 12/1975 | Ward et al. . | |
| 4,165,124 | 8/1979 | Olan | 5/58 X |
| 4,495,135 | 1/1985 | White . | |
| 4,811,438 | 3/1989 | Simpson . | |
| 4,960,556 | 10/1990 | Oehlenschlaeger et al. . | |
| 4,971,390 | 11/1990 | McGinley | 312/334.23 X |
| 5,188,442 | 2/1993 | Harty et al. . | |
| 5,244,272 | 9/1993 | Thompson | 312/330.1 X |
| 5,352,031 | 10/1994 | Nahrgang | 312/237 X |

*Primary Examiner*—Peter M. Cuomo
*Assistant Examiner*—Rodney B. White
*Attorney, Agent, or Firm*—Bell, Seltzer, Park & Gibson

[57] ABSTRACT

A seating unit comprises a base that includes a seat portion and a drawer cavity therebeneath. The base includes a pair of support rails on opposite sides of the drawer cavity. A drawer fits within the cavity and comprises a generally horizontal floor and a pair of generally upright side walls of a predetermined thickness integrally formed with the floor. Each of the side walls comprises an upright portion extending upwardly a predetermined height from the floor, a ramped portion having a predetermined width and slope angle formed integrally with the upright portion and sloping upwardly and inwardly therefrom, a recessed portion attached above and formed integrally with the ramped portion, and an outwardly-projecting lip attached above and formed integrally with the recessed portion. The recessed portion extends the horizontal length of the side wall. The lip has a free end projecting outwardly from its corresponding upright wall portion. The ramped portion, recessed portion and lip are configured to receive and slide upon the support rails of the seating unit base. The predetermined side wall thickness, the predetermined upright portion height, and the ramped portion width and slope angle, are selected so that, as the drawer is supported on the support rails and a substantial downwardly-directed force is applied to the drawer floor, the side walls deflect inwardly sufficiently that the drawer dislocates from the support rails and remains intact.

21 Claims, 4 Drawing Sheets

SEATING UNIT WITH DISLOCATABLE DRAWER

FIELD OF THE INVENTION

This invention is related generally to drawers, and is related more particularly to drawers integrated into seating units.

BACKGROUND OF THE INVENTION

With the trend toward increased use of the living room or den as a recreational and entertainment space, many consumers desire seating units that provide function beyond the seating and support provided by conventional seating units. One functional area of interest to consumers, particularly when living space is limited, is increased storage capacity. Especially in rooms used for family entertainment, consumers desire convenient receptacles for the storage of reading materials, remote control units for televisions, stereos, and video cassette recorders, playing cards, games, and the like. Furniture units, such as end tables, desks, and ottomans, that contain storage receptacles for items of this sort can provide additional storage while simultaneously serving the more traditional functions of these pieces.

One class of furniture unit that has been utilized for storage, although somewhat less than it might have been, is seating units, such as sofas, couches, love seats, and chairs. An exemplary seating unit having storage capability is disclosed in U.S. Pat. No. 2,671,228 to DeMaria, which illustrates a sofa bed that includes a pair of storage drawers. The drawers are positioned side- by-side beneath the seating surface of the sofa and can be accessed from the front of the sofa. Their sliding movement is controlled by a centrally located beam and by the frame that defines the front surface of the sofa. The drawers are formed of interconnected wood planks. Other drawers that have been included beneath sofas have been mounted on drawer slides formed of wood or metal.

One shortcoming of drawers of this type has been their durability. These drawers can be overloaded with the weight of various stored items. Also, because of the low position of the drawer, it is particularly susceptible to being kicked or stepped on, particularly by children, when it is partially or completely open. When such overloading occurs, the tendency has been for either the drawer itself or for slide rails supporting the drawer to fracture. Although it is certainly undesirable for the drawer to fracture, it is particularly undesirable for the rails to fracture, as such fracture requires a very awkward repair task beneath the sofa itself.

Drawers have been constructed from materials other than wood. For example, U.S. Pat. No. 3,610,720 to Hosmer, which discloses a drawer "for an item of furniture," is predominantly formed of thermoplastic. The drawer is configured to have indentations in its side walls to receive rails upon which it slides. The floor, side walls, and rear wall are integrally formed of an injection-molded structural foam thermoplastic. This subassembly is then attached through screws and brackets to a separate wooden face plate. Hosmer states that the purpose for using the thermoplastic piece is to eliminate the warpage seen in wooden drawers and to reduce weight and expense over wooden drawers. Additionally, U.S. Pat. No. 3,312,516 to Krahn discloses a three-piece drawer that includes side walls formed of an extruded thermoplastic rail and a separate floor formed of a plastic, plywood, composition board, or other compressed or laminated material. After the rail profile is extruded, the rail is heated and bent to form the side and rear walls of the drawer. Once formed, the side walls have a indented portion beneath an overhanging flange that mates with a drawer slide rail and a protruding pocket that receives and mates with the floor. A front cross piece is attached to the side walls and floor. Each of the drawers disclosed in these references comprises multiple pieces and thus has some significant labor expense in assembly.

In view of the foregoing, it is an object of the present invention to provide a drawer suitable for use with a seating unit that remains intact when heavily loaded with storage items.

It is another object of the present invention to provide a drawer suitable for use with a seating unit that remains intact if stepped on or jarred while in partially or completely open position.

It is a further object of the present invention to provide a drawer suitable for use with a seating unit that can be easily and relatively inexpensively manufactured.

SUMMARY OF THE INVENTION

These and other objects are satisfied by the present invention, which provides a seating unit with a drawer that does not fracture when mounted on drawer slides and overloaded. The seating unit of the present invention comprises a base that includes a seat portion and a drawer cavity therebeneath. The base includes a pair of support rails on opposite sides of the drawer cavity. A drawer fits within the cavity and comprises a generally horizontal floor and a pair of generally upright side walls of a predetermined thickness integrally formed with the floor. Each of the side walls comprises an upright portion extending upwardly a predetermined height from the floor, a ramped portion having a predetermined width and slope angle formed integrally with the upright portion and sloping upwardly and inwardly therefrom, a recessed portion attached above and formed integrally with the ramped portion, and an outwardly-projecting lip attached above and formed integrally with the recessed portion. The recessed portion extends the horizontal length of the side wall. The lip has a free end projecting outwardly from its corresponding upright wall portion. The ramped portion, recessed portion and lip are configured to receive and slide upon the support rails of the seating unit base. The predetermined side wall thickness, the predetermined upright portion height, and the ramped portion width and slope angle are selected so that, as the drawer is supported on the support rails and a substantial downwardly-directed force is applied to the drawer floor, the side walls deflect inwardly sufficiently that the drawer dislocates from the support rails and remains intact.

BRIEF DESCRIPTION OF THE DRAWINGS

Some of the features and advantages of the invention have been stated, others will become apparent from the detailed description which follows, and from the accompanying drawings, in which.

DETAILED DESCRIPTION OF THE INVENTION

The present invention now will be described more fully hereinafter with reference to the accompanying drawings, in which a preferred embodiment of the invention is shown. This invention may, however, be embodied in many different forms and should not be construed as limited to the embodiments set forth herein; rather, this embodiment is provided so that this disclosure will be thorough and complete, and will fully convey the scope of the invention to those skilled in this art.

As used herein, "forward", "forwardly" and "front" all refer to the direction parallel with the floor extending from the backrest of the seating unit toward the seating surface of the seating unit. Conversely, the terms "rear", "rearward", and "rearwardly" all refer to the direction parallel with the floor extending from the seating surface toward the backrest. The term "lateral" refers to the direction parallel with the floor, perpendicular to the forward and rearward directions, and extending away from a vertically-disposed plane bisecting the seating unit. The terms "medial," "inward", and "inboard" all refer to the direction that is the converse of the lateral direction, i.e., the direction parallel with the floor, perpendicular to the forward direction, and extending from the periphery of the seating unit toward its bisecting plane.

Figure 1:
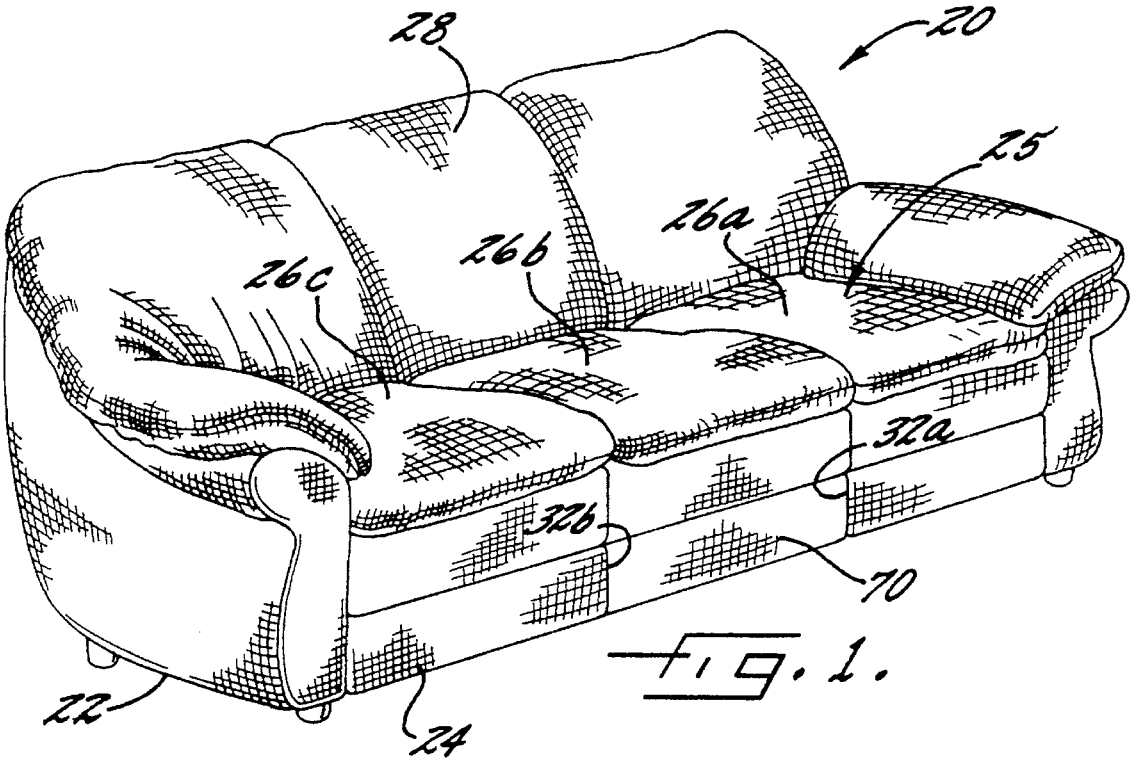
FIG. 1 is a perspective view of a sofa that includes a drawer of the present invention.

Referring now to the drawings, a sofa illustrated broadly at 20 is shown in FIG. 1. The sofa 20 includes a base 22 having a front panel 24, a seat surface 25 comprising a trio of seat cushions 26*a*, 26*b*, 26*c*, and a backrest 28 fixed to the rearward portion of the base 22 rearward of the seat cushions 26*a*, 26*b*, 26*c*.

Figure 2:
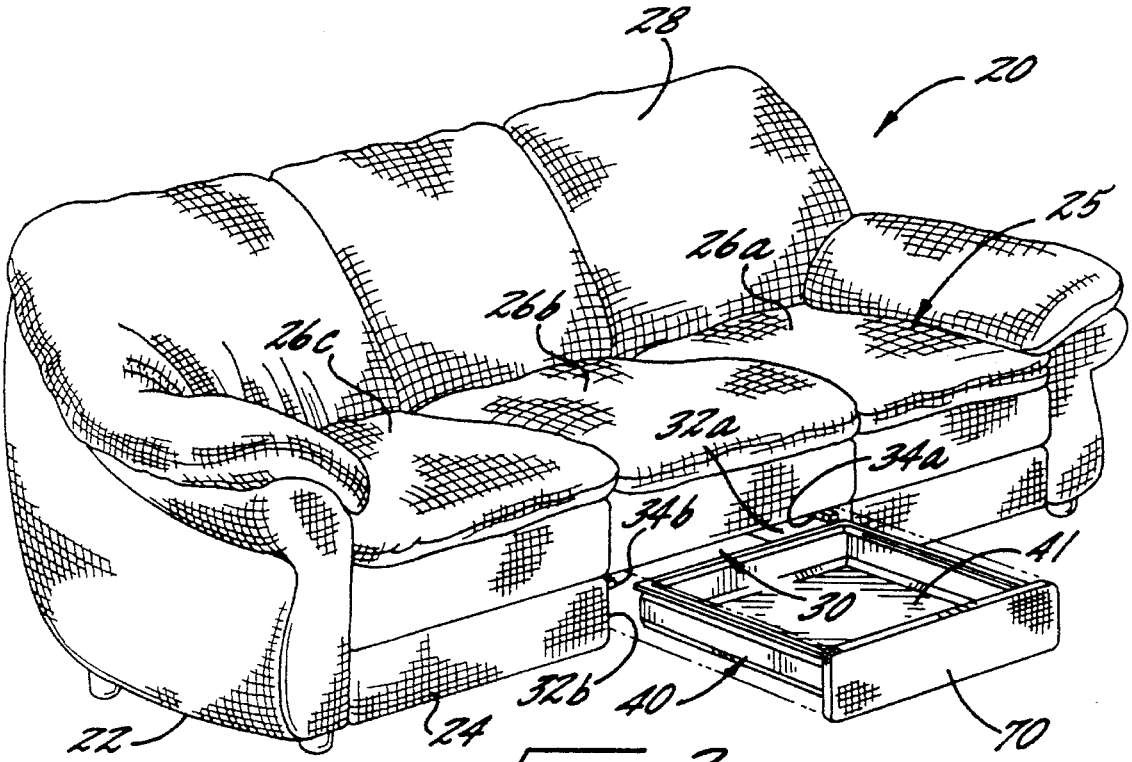
FIG. 2 is a perspective view of the sofa of FIG. 1 with the drawer in an open position.
Figure 3:
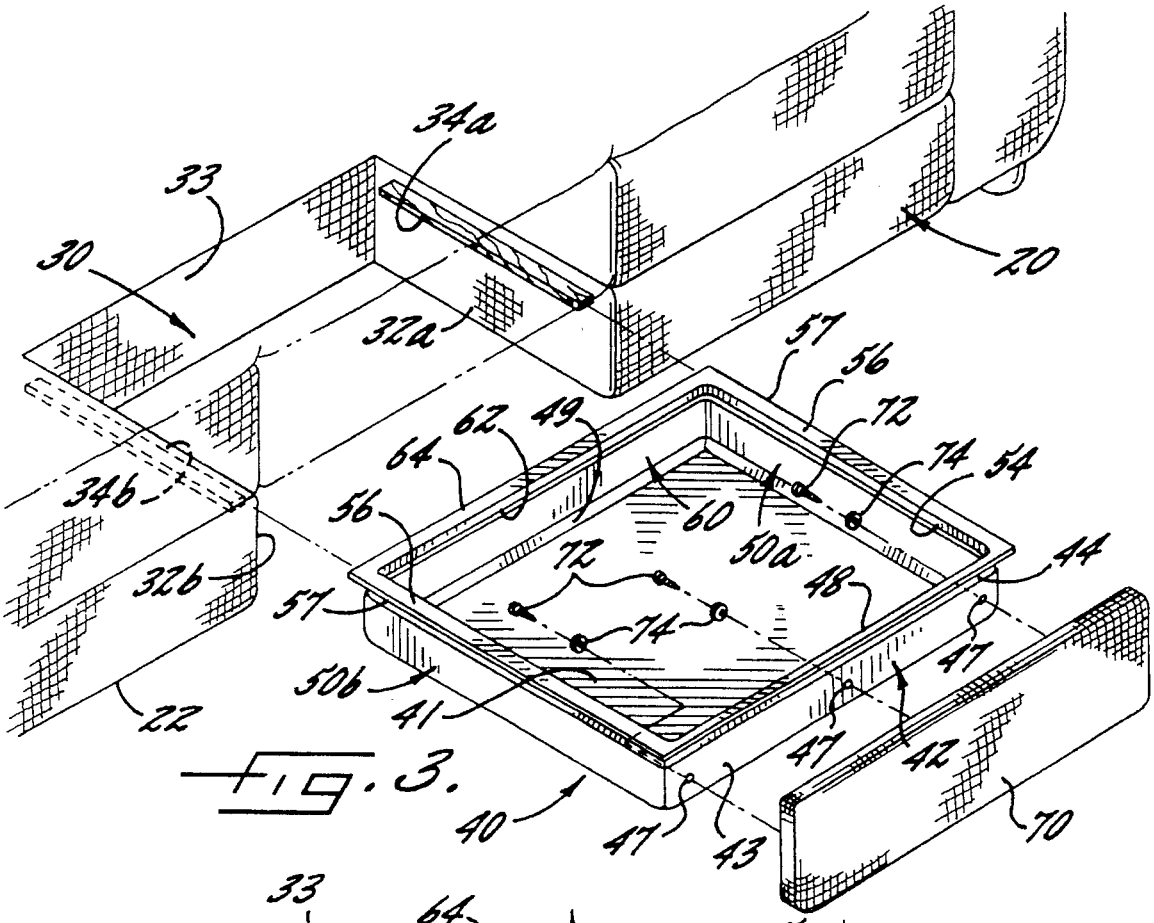
FIG. 3 is an enlarged exploded perspective view of the drawer of FIG. 1.

A drawer cavity 30 (FIGS. 2 and 3) is located beneath the center seat cushion 26*b*. The drawer cavity 30 is defined on opposite sides by a pair of side panels 32*a*, 32*b* and at the rear by a rear panel 33. Each of a pair of slide rails 34*a*, 34*b* is fixed in a substantially horizontal disposition to an upper portion of a respective side panel 32*a*, 32*b* via threaded fasteners or other mounting means. Each slide rail 34*a*, 34*b* is generally rectangular in cross-section and projects inwardly from and extends along the length of its corresponding side panel 32*a*, 32*b*. These slide rails 34*a*, 34*b* are typically fashioned from wood and measure between about 15 and 25 inches in length and between about 0.25 and 1 inch in height; each also projects inwardly from the side panel between about 0.5 and 2 inches.

Although a sofa having three or more seating portions (represented by the seat cushions 26*a*, 26*b*, 26*c*) is preferred, those skilled in this art will appreciate that other seating units having sufficient volume beneath their respective seat surfaces to provide a storage cavity are also suitable for use with the present invention. Exemplary alternative seating units include couches, love seats, easy chairs, pit-style seating units, and the like.

Figure 4:
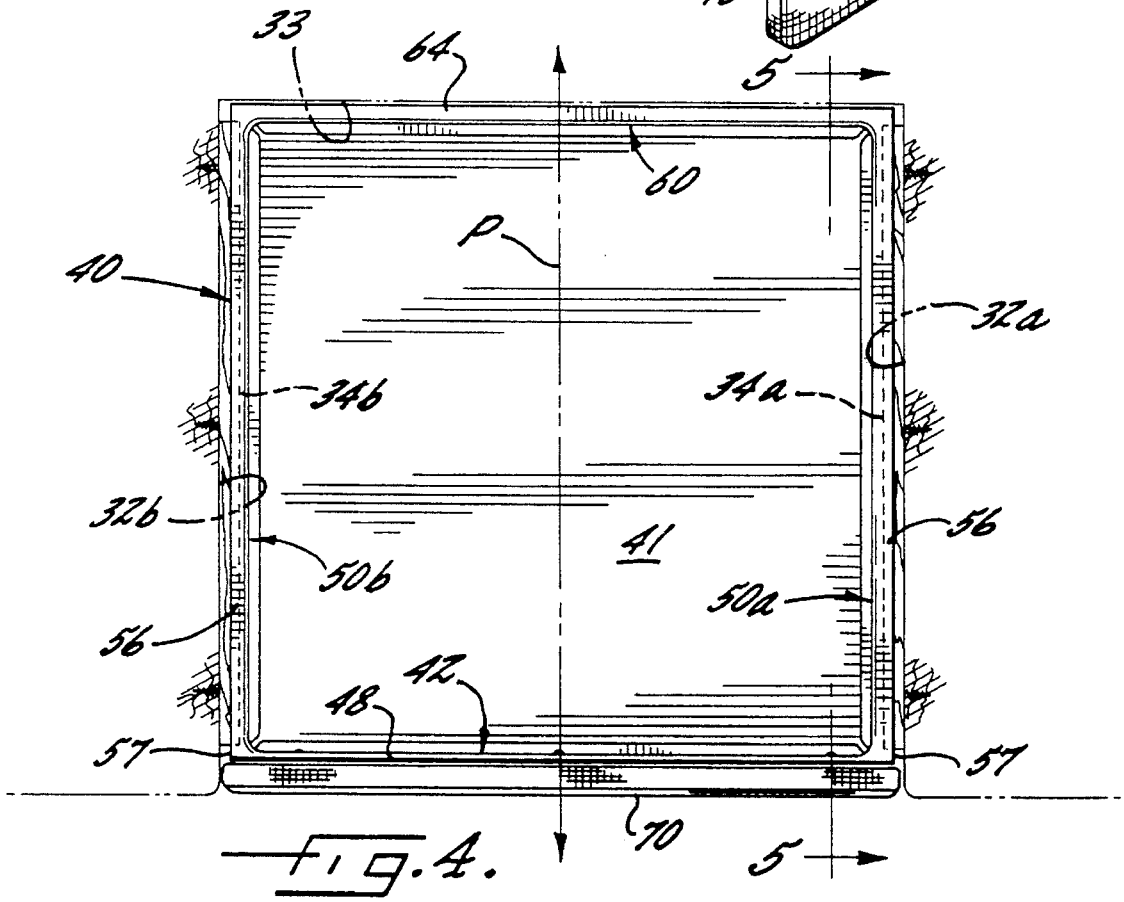
FIG. 4 is top view of the drawer of FIG. 1 in its closed position showing its interaction with the slide rails of the sofa.
Figure 5:
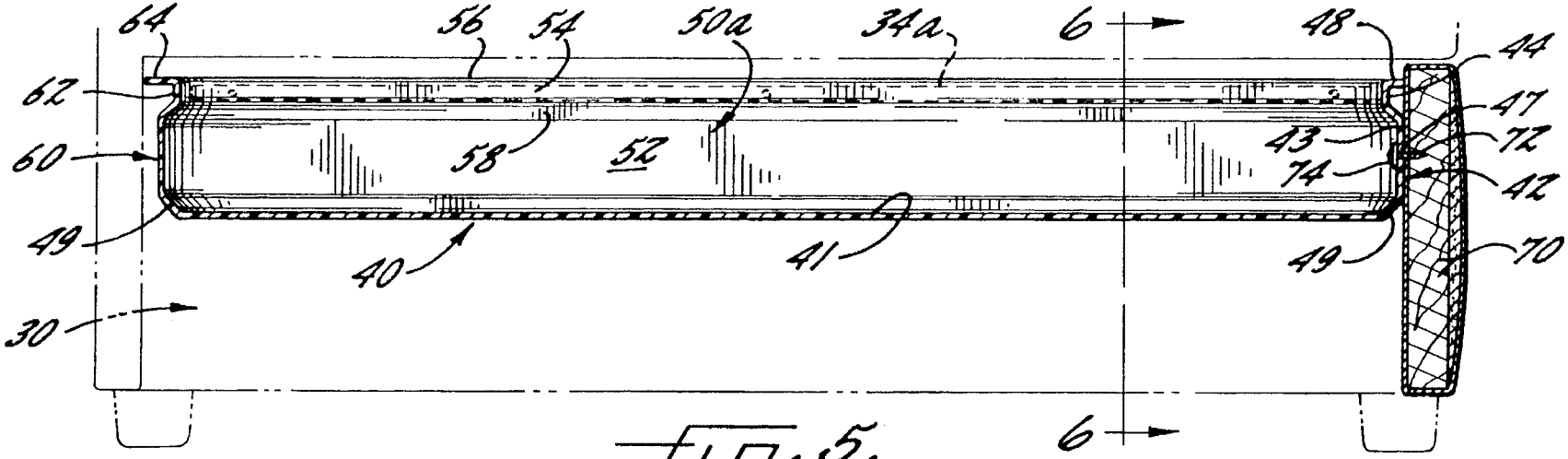
FIG. 5 is a cross-sectional side view of the drawer of FIG. 1 in its closed position.
Figure 6:
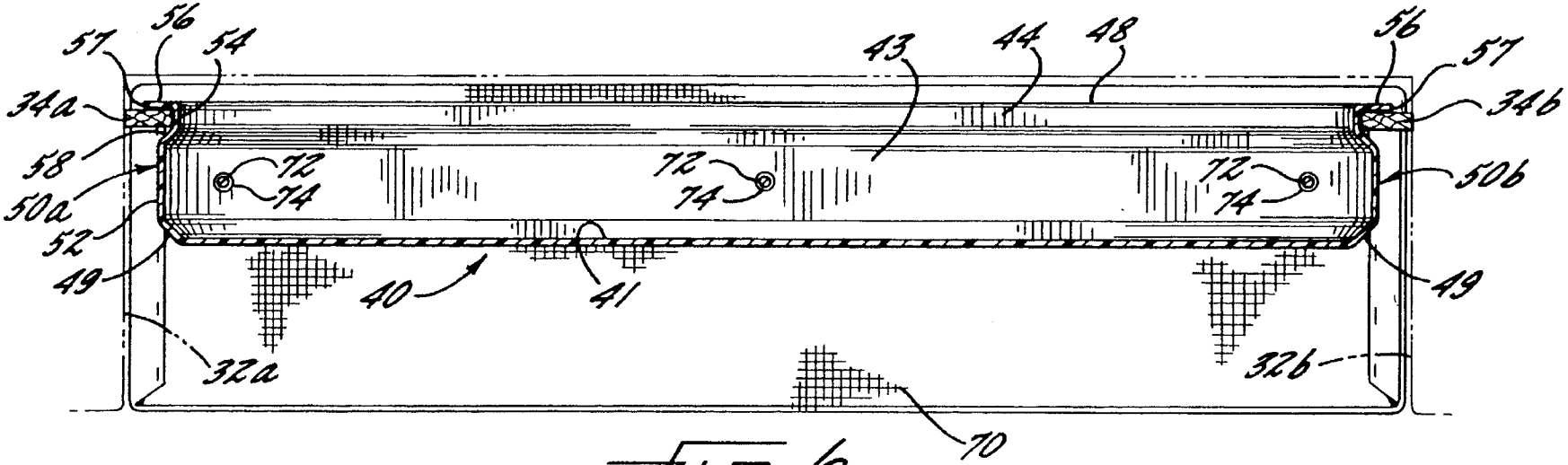
FIG. 6 is a cross-sectional front view taken along line 6—6 of FIG. 5.

A drawer 40 (FIGS. 3 through 6) fits within the sofa cavity 30. The drawer 40 comprises a generally planar and horizontally disposed floor 41 (FIG. 4) having beveled edges 49 (FIG. 6), a generally upright front wall 42, a pair of generally upright side walls 50*a*, 50*b*, and a generally upright rear wall 60. These structures are integrally formed into a box-like structure in which items, such as reading materials, writing utensils, remote control devices, and the like, can be stored.

The front wall 42 (FIGS. 3 and 6) includes a lower upright portion 43, a rearwardly-recessed portion 44 that merges with the upper end of the upright portion 43, and a forwardly-extending front lip 48 that merges at its free end with the upper end of the recessed portion 44. Inclusion of the recessed portion 44 and front lip 48 is preferred to provide the drawer with additional rigidity. The upright portion 43 includes three panel apertures 47 spaced across its length for attachment of a front panel 70.

The side walls 50*a*, 50*b* are mirror images of one another across a vertical plane of symmetry P (FIG. 4) that bisects the drawer longitudinally. In the interest of brevity and clarity, only the side wall 50*a* will be described in detail hereinafter; those skilled in this art will appreciate that the description is equally applicable to the mirror image side wall 50*b*.

The side wall 50*a* (FIGS. 3 and 6), which extends generally upright from the lateral floor beveled edges 49, comprises an upright portion 52, an upwardly and inwardly sloping ramped portion 58, recessed portion 54, and an outwardly-extending lip 56. The upright portion 52 extends generally upwardly from its attachment with a lateral beveled edge 49. Preferably, the upright portion 52 is between about 1.5 and 4 inches in height; this height range enables the drawer 40 to fit beneath a large majority of conventional seating units.

The ramped portion 58 (seen best in FIG. 6) is integrally formed with the upper end of the upright portion 52 and slopes inwardly and upwardly therefrom. Positioned there, the ramped portion 58 provides the lower portion of the pocket within which the rails 34*a*, 34*b* are received. Preferably, the ramped portion 58 has a width of between about 0.125 and 0.75 inches (more preferably between about 0.25 and 0.5 inches) and slopes upwardly at a slope angle (measured relative to the floor 41) of between about 30 and 60 degrees. The ramped portion 58 may be a planar surface or, as is preferred, may have some curvature to reduce any concentration of stress induced therein.

The recessed portion 54 (FIG. 6) projects inwardly from the lateral end of the ramped portion 58 and extends horizontally the entire length of the side wall 50*a*. The recessed portion 54 is sized and configured to receive and slide longitudinally upon the side rail 34*a* of the sofa cavity 30. Preferably, the recessed portion 54 is between about 0.25 and 1.0 inches in height.

Figure 10:
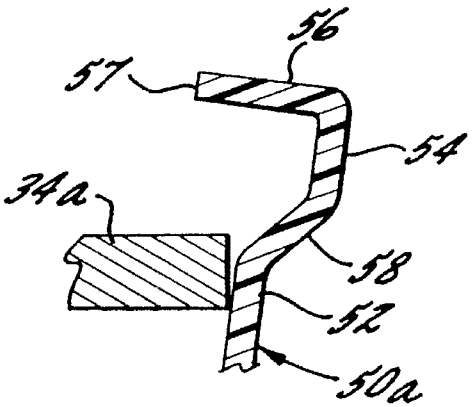
FIG. 10 is a greatly enlarged cross-sectional view of the drawer recessed portion and lip taken along lines 10—10 of FIG. 7 showing how the ramped portion, lip, and recessed portion dislocate from the slide rail and remain intact when the drawer is under a substantial downwardly-directed load.
Figure 9:
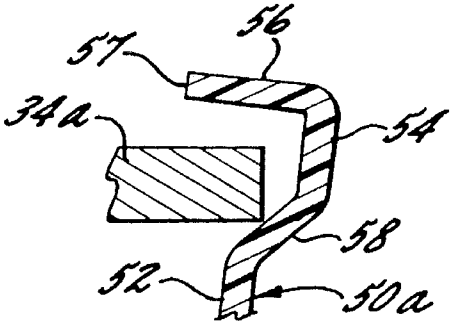
FIG. 9 is a greatly enlarged cross-sectional view of the drawer upright portion, ramped portion, recessed portion and lip taken along lines 9—9 of FIG. 7 showing the deflection thereof relative to the slide rail when the drawer is under a significant downwardly-directed load.
Figure 8:
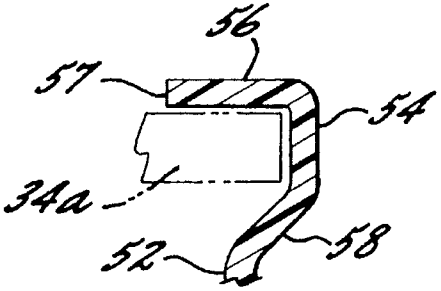
FIG. 8 is a greatly enlarged cross-sectional view of the drawer of FIG. 7 showing the interaction between the ramped portion, recessed portion, and lip of the drawer and one of the sofa slide rails.

The lip 56, which illustratively and preferably extends longitudinally the entire length of the side wall 50, projects generally horizontally and outwardly from the upper end of the recessed portion 54 to terminate in a free end 57 (FIGS. 8 through 10). The free end 57 is positioned outwardly from the side wall upright portion 52. The lip 56 is configured to rest and slide upon the upper surface of the rail 34*a*. It is preferred that the lip 56 extend laterally so that its free end 57 is lateral of the upright portion 52; more preferably, the lip 56 projects between about 0.5 and 1.5 inches from the upper end of the recessed portion 54.

The rear wall 60 (FIG. 5) extends between the rear edges of the side walls 50*a*, 50*b* and upwardly from the rear end portion of the floor 42. The rear wall 60 includes a forwardly-directed recessed portion 62 that is contiguous with the recessed portions 54 of the side walls 50*a*, 50*b*, and further includes a rearwardly-extending lip 64 that is contiguous with the lips 56 of the side walls 50*a*, 50*b*. The inclusion of the recessed portion 6 and the lip 64 provides the rear wall 60 additional rigidity.

The front, side and rear walls 42, 50*a*, 50*b*, and 60 and the floor 41 of the drawer 40 are formed as a single integral piece. Preferably, such a single piece is formed of a thermoplastic, such as polystyrene, acrylonitrile-butadiene-styrene terpolymer, polycarbonate, or the like. It is also preferred that the material has a flexural modulus of elasticity of between about 150,000 and 350,000 psi. If formed from a thermoplastic, the drawer 40 is preferably formed by a process known as thermoforming (also known as vacuum-forming or vacuum-drawing) in which a heated extruded plastic sheet, typically of essentially constant thickness, is drawn by vacuum into a female mold to form a desired shape. See Schott & Malloy, *Polymer Processing*, in *Applied Polymer Science* 602-604 (American Chemical Society 1985) for a general discussion of thermoforming processes.

The use of thermoforming as the production method of the drawer 40 can have certain consequences. For example, in a preferred embodiment of the present invention, the drawer 40 is thermoformed using a "break-away" mold; this mold includes four elongate inserts of rectangular cross-section that form the recessed portions 44, 54, 62 during processing and that are removed from the mold along with the drawer after cooling. In this mold, there is no specific structure that forms the ramped portion 58; rather, the slope angle and the degree of planarity of the ramped portion 58 are dependent on the magnitude of the vacuum employed and the wall thickness rather than by the shapes of the mold and mold inserts.

In addition, although the typical thermoformed sheet is of substantially constant thickness, as the material is drawn into the mold, it can become thinner in regions in which the material must be drawn into the mold a considerable distance. Thus in a thermoformed drawer of the present invention, the side walls 50*a*, 50*b* may be somewhat thinner than the floor 42 with the exception of the lip 56; typically, the thickness ratio of the floor 42 to the upright portion 52 is between about 0.6:1 to 0.99:1.

It should be noted that, in order to facilitate removal of a molded part from a thermoforming mold, a female mold typically is fashioned to have lateral walls that are sloped slightly outwardly. The slope angle, known to those skilled in this art as the "draft" angle, is typically between about 1 to 5 degrees. In the drawer of the present invention, it is preferred that the side walls 50*a*, 50*b* have draft angles of between about 1 and 4 degrees. It is also preferred that the rear wall 60 have a draft angle of between about 3 to 6 degrees, and more preferably about 5 degrees. This shallower draft angle on the rear wall 60 enables the drawer 40 to be removed from the mold despite having a front wall 42 with little or no draft angle, as is preferred for attachment of the front panel 70. It is intended that the term "generally upright" encompasses structures such as those just described having the above-noted draft angles.

The front panel 70 (FIGS. 3 and 5) is attached to the front wall through three threaded fasteners 72, which are inserted through washers 74, through the panel apertures 47 in the front wall upright portion 43, and into the rear surface of the front panel 70. The front panel 70, which is typically upholstered to match the color and form of the remainder of the sofa 20, is configured to align and be essentially coplanar with the front panel 24 of the sofa 20 when the drawer 40 is closed.

The drawer 40 is movable between a closed position (FIG. 1), in which the drawer 40 is positioned within tile cavity 30 to underlie the center seat cushion 26*b*, and an open position (FIG. 2), in which the drawer 40 is positioned forwardly of the cavity 30 and the items stored therein are accessible. In moving from the open and closed positions, the drawer 40 is supported by and slides upon the rails 34*a*, 34*b*, which are received within recessed portions 54 and beneath lips 56.

Figure 7:
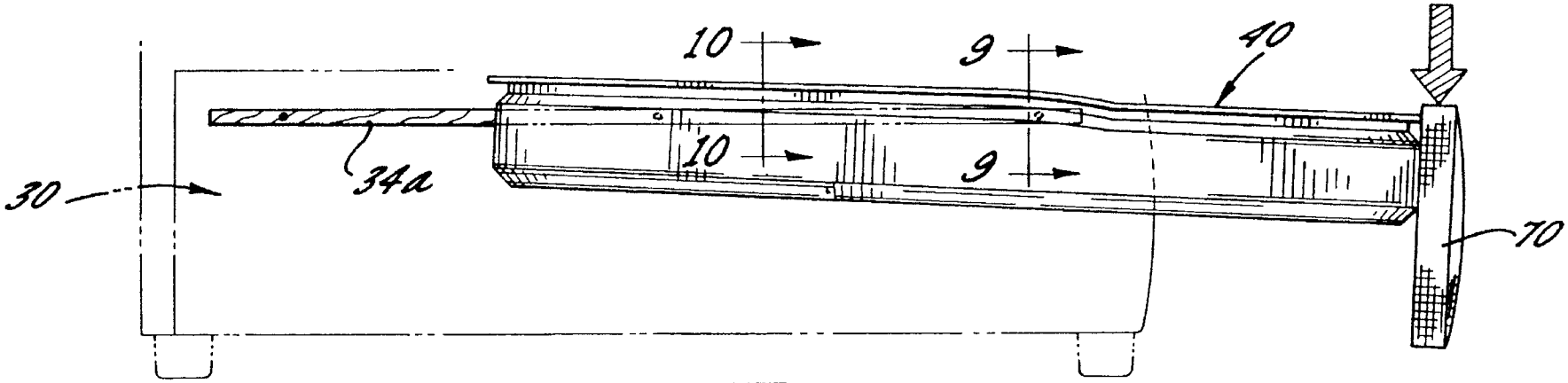
FIG. 7 is a side view of a drawer in a partially open position having a substantial downwardly-directed force applied to its front wall.

The dislocation capability of the drawer 40 is illustrated in FIGS. 7 through 10. FIG. 7 shows the drawer 40 as it is supported by the rail 34*a* in a partially open position, and FIG. 8 illustrates the typical interaction between the rails 34*a* and the lip 56, recessed portion 54, and ramped portion 58. As the drawer 40 receives a substantial downwardly-directed force, such as can occur when someone inadvertently steps upon or kicks the drawer 40 as it is in its open position, the upright portion 52, the ramped portion 58, the recessed portion 54, and the lip 56 deflect in response (FIG. 9). In particular, the upright portion 52 deflects so that its upper end deflects inwardly, and the ramped portion 58 deflects so that the angle between the ramped portion 58 and the upright portion 52 increases. The lateral surface of the ramped portion 58 provides a sloped surface on which it can slide relative to the lower inner edge of rail 34*a*. The ramped configuration of the ramped portion 58 encourages the upright portion 52 to deflect inwardly rather than bowing or crushing, as it might were the ramped surface substantially horizontal. As a result, the upright portion 52 deflects sufficiently that it deflects to and past the inwardmost portion of the rail 34*a* (FIG. 10), which action enables the drawer 40 to dislocate from the rail 34*a* without breaking. The side wall 50 has sufficient resiliency that it returns to its original undeformed configuration, and thus remains intact and usable, rather than either fracturing or becoming so deformed that it is no longer usable.

The foregoing embodiments are illustrative of the present invention, and are not to be construed as limiting thereof. The invention is defined by the following claims, with equivalents of the claims to be included therein.

That which is claimed is:

1. A drawer comprising:

a generally horizontal floor; and a pair of generally upright side walls of a predetermined thickness integrally formed with said floor, each of said side walls comprising an upright portion extending a predetermined height upwardly from said floor, a ramped portion integrally formed with said upright portion and sloping upwardly and inwardly therefrom, a lower end of said ramped portion directly merging with an upper end of said upright portion, said ramped portion having a predetermined width and slope angle, a recessed portion of a predetermined height attached above and formed integrally with said ramped portion, a lower end of said recessed portion directly merging with an upper end of said ramped portion and being positioned generally inwardly of said upright portion upper end, and an outwardly-projecting lip attached above and formed integrally with said recessed portion of a predetermined width, said ramped portion and said recessed portion extending the horizontal length of said side wall, said lip having a free end projecting outwardly from its corresponding upright wall portion, said ramped portion, recessed portion, and lip being configured to receive and slide upon a support rail, wherein said predetermined side wall thickness, said predetermined upright portion height, and said predetermined ramped portion width and slope angle are selected so that, as said drawer is supported on supporting rails and a substantial downwardly-directed force is applied to said floor, said upright portions deflect inwardly sufficiently that drawer dislocates from the support rails and remains intact.

2. The drawer defined in claim 1, wherein said predetermined side wall thickness is between about 0.150 and 0.2 inches.

3. The drawer defined in claim 1, wherein said drawer is formed of a thermoplastic material having a flexural modulus of elasticity of between about 150,000 and 350,000 pounds per square inch.

4. The drawer defined in claim 1, wherein said predetermined ramped portion width is between about 0.125 and 0.75 inches.

5. The drawer defined in claim 1, wherein said predetermined lip width is between about 0.5 and 1.5 inches.

6. The drawer defined in claim 1, further comprising a generally upright front wall integrally formed with and between said floor and said side walls.

7. The drawer defined in claim 6, further comprising an upholstered panel attached generally parallel to said front wall.

8. The drawer defined in claim 6, further comprising a generally upright rear wall integrally formed with and between said floor and said side walls.

9. The drawer defined in claim 1, wherein said predetermined slope angle is between about 30 and 60 degrees relative to said floor.

10. A seating unit comprising:

a base including a seat portion and a drawer cavity beneath said seat portion, said base comprising a pair of support rails on opposite sides of said cavity; and a drawer comprising a generally horizontal floor; and a pair of generally upright side walls of a predetermined thickness integrally formed with said floor, each of said side walls comprising an upright portion extending a predetermined height upwardly from said floor, a ramped portion integrally formed with said upright portion and sloping upwardly and inwardly therefrom, a lower end of said ramped portion directly merging with an upper end of said upright portion, said ramped portion having a predetermined width and slope angle, a recessed portion of a predetermined height attached above and formed integrally with said ramped portion, a lower end of said recessed portion directly merging with an upper end of said ramped portion and being positioned generally inwardly of said upright portion upper end, and an outwardly-projecting lip attached above and formed integrally with said recessed portion of a predetermined width, said ramped portion and said recessed portion extending the horizontal length of said side wall, said lip having a free end projecting outwardly from its corresponding upright wall portion, said ramped portion, recessed portion, and lip being configured to receive and slide upon a support rail, wherein said predetermined side wall thickness, said upright portion height, and said ramped portion width and slope angle are selected so that, as said drawer is supported on said support rails and a substantial downwardly-directed force is applied to said floor, said side walls deflect inwardly sufficiently that drawer dislocates from the support rails and remains intact.

11. The seating unit defined in claim 10, wherein said predetermined side wall thickness is between about 0.150 and 0.200 inches.

12. The seating unit defined in claim 10, wherein said drawer is formed of a thermoplastic material having a flexural modulus of elasticity of between about 150,000 and 350,000 pounds per square inch.

13. The seating unit defined in claim 10, wherein said predetermined ramped portion width is between about 0.125 and 0.75 inches.

14. The seating unit defined in claim 10, wherein said predetermined lip width is between about 0.5 and 1.5 inches.

15. The seating unit defined in claim 10, wherein said drawer further comprises a generally upright front wall that extends between said pair of side walls.

16. The seating unit defined in claim 15, wherein said drawer further comprises a generally upright rear wall integrally formed with and between said floor and said side walls.

17. The seating unit defined in claim 16, wherein said drawer further comprises an upholstered panel attached generally parallel to said front wall, wherein said seating unit base further includes a front panel, and wherein said drawer upholstered panel resides generally coplanar with said seating unit base front panel.

18. The seating unit defined in claim 17, wherein said seating unit seat portion comprises one central and two lateral seat subportions, said subportions being serially aligned and substantially equally sized, each of which is configured to receive a seated occupant, and wherein said drawer cavity is positioned beneath said central seat subportion.

19. The seating unit defined in claim 10, wherein said predetermined slope angle is between about 30 and 60 degrees relative to said floor.

20. A drawer comprising:

a generally horizontal floor; and a pair of generally upright side walls of a predetermined thickness of between about 0.150 and 0.200 inches connected with said floor, said side walls each including an upright portion having a predetermined height of between about 1.5 and 4.0 inches, a ramped portion integrally formed with said upright portion and sloping upwardly and inwardly therefrom, said ramped portion having a predetermined width of between about 0.125 and 0.75 inches and a slope angle of between about 30 and 60 degrees, a lower end of said ramped portion directly merging with an upper end of said upright portion, a recessed portion of a predetermined height of between about 0.25 and 1.0 inches positioned above and integrally formed with said recessed portion, a lower end of said recessed portion directly merging with an upper end of said ramped portion and being positioned inwardly from said upright portion upper end, and an outwardly-projecting lip above said recessed portion, said ramped portion and said recessed portion extending the horizontal length of said side wall, said ramped portion, recessed portion, and lip being configured to receive and slide upon a support rail, wherein as said drawer is supported on supporting rails and a substantial downwardly-directed force is applied to said floor, said side walls deflect inwardly sufficiently that drawer dislocates from the support rails and remains intact responsive to said downwardly-directed force.

21. The drawer defined in claim 20, wherein said drawer is formed of a thermoplastic material having a flexural modulus of elasticity of between about 150,000 and 350,000 pounds per square inch.

* * * * *

UNITED STATES PATENT AND TRADEMARK OFFICE

CERTIFICATE OF CORRECTION

PATENT NO. : 5,520,436

DATED : May 28, 1996

INVENTOR(S) : Rader et al.

It is certified that error appears in the above-identified patent and that said Letters Patent is hereby corrected as shown below:

Column 5, Line 19, delete "6" and insert --62--.

Signed and Sealed this

Twenty-seventh Day of August, 1996

Bruce Lehman

*Attest:*

BRUCE LEHMAN

*Attesting Officer*

*Commissioner of Patents and Trademarks*